US007162747B2

(12) United States Patent
Sampy

(10) Patent No.: US 7,162,747 B2
(45) Date of Patent: Jan. 16, 2007

(54) NECKTIE KNOT PROTECTOR

(76) Inventor: Maxie Sampy, 12739 Walnut Bend Ct., Missouri City, TX (US) 77489

( * ) Notice: Subject to any disclaimer, the term of this patent is extended or adjusted under 35 U.S.C. 154(b) by 203 days.

(21) Appl. No.: 11/002,320

(22) Filed: Dec. 3, 2004

(65) Prior Publication Data

US 2005/0076417 A1 Apr. 14, 2005

Related U.S. Application Data

(63) Continuation-in-part of application No. 10/423,196, filed on Apr. 25, 2003, now abandoned.

(51) Int. Cl.
*A41D 25/08* (2006.01)

(52) U.S. Cl. ..... 2/152.1

(58) Field of Classification Search ..... 2/144–151, 2/152.1, 153–157; 24/49.1, 65
See application file for complete search history.

(56) References Cited

U.S. PATENT DOCUMENTS

| | | | | |
|---|---|---|---|---|
| 2,316,002 | A | 4/1943 | Koivisto | |
| 2,617,108 | A | 11/1952 | Anzell | |
| 2,702,905 | A * | 3/1955 | Peake | 2/153 |
| 2,714,719 | A | 8/1955 | Peake | |
| 2,728,801 | A | 12/1955 | Toplansky | |
| 5,010,593 | A | 4/1991 | Stevens, Jr. | |
| D364,723 | S | 12/1995 | Cox | |
| D420,201 | S | 2/2000 | Azhar et al. | |
| 6,367,127 | B1 | 4/2002 | Lee | |
| 6,687,915 | B1 | 2/2004 | Kear | |

* cited by examiner

*Primary Examiner*—Tejash Patel
(74) *Attorney, Agent, or Firm*—Richard C. Litman

(57) ABSTRACT

The tie knot protector of the present invention is generally triangular shape forming a shell configured to slip over a knot in a necktie from below and having a hook tab which attaches over the front portion of the tie knot, thereby remaining in place. The tie knot protector may be made of metal or plastic material and may, itself, be decorative.

4 Claims, 4 Drawing Sheets

NECKTIE KNOT PROTECTOR

CROSS REFERENCE TO RELATED APPLICATION

This application is a continuation-in-part of application Ser. No. 10/423,196, filed Apr. 25, 2003 now abandoned.

BACKGROUND OF THE INVENTION

1. Field of the Invention

The present invention relates to wearing apparel. More particularly, the present invention relates to protectors for a necktie knot.

2. Description of the Related Art

Under normal use a necktie is subject to wear due to, in part, frequent contact with the wearer's chin, particularly the knot of the tie. The knot, itself, wears, resulting in material wear and tear, and general degradation of the necktie. It would be desirable to provide a protective cover for the knot of a necktie which is simple in design and use and preserves the tie for continued use. The protective tie cover, itself, may be decorative.

Thus a tie knot protector solving the aforementioned problem is desired.

SUMMARY OF THE INVENTION

The tie knot protector of the present invention is generally triangular in shape, forming a shell configured to slip over a knot in a necktie from below and having a hook tab which attaches over the front portion of the tie knot, thereby remaining in place. The tie knot protector may be made of metal or plastic material and may, itself, be decorative.

It is an aspect of the invention to provide improved elements and arrangements thereof for the purposes described which is inexpensive, dependable and fully effective in accomplishing its intended purposes.

These and other aspects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention is a necktie knot protector for protecting the knot from wear. The knot protector is in the form of a shell surrounding the knot. The knot protector is held in place by an inward hook tab extending inward within the shell from the central part of the upper rim of the necktie protector shell.

Figure 1:
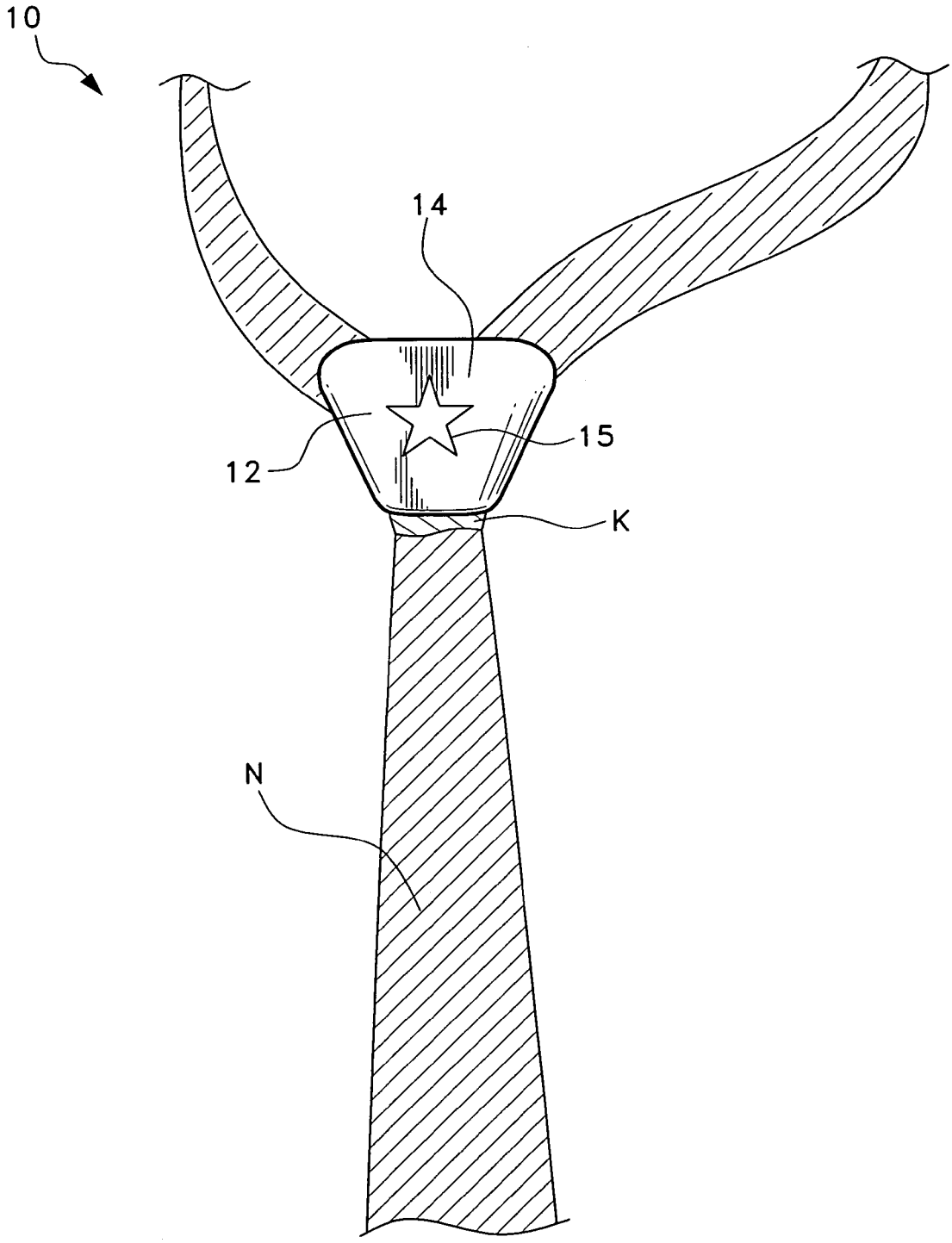
FIG. 1 is an environmental, perspective view of the tie knot protector according to the present invention.
Figure 2:
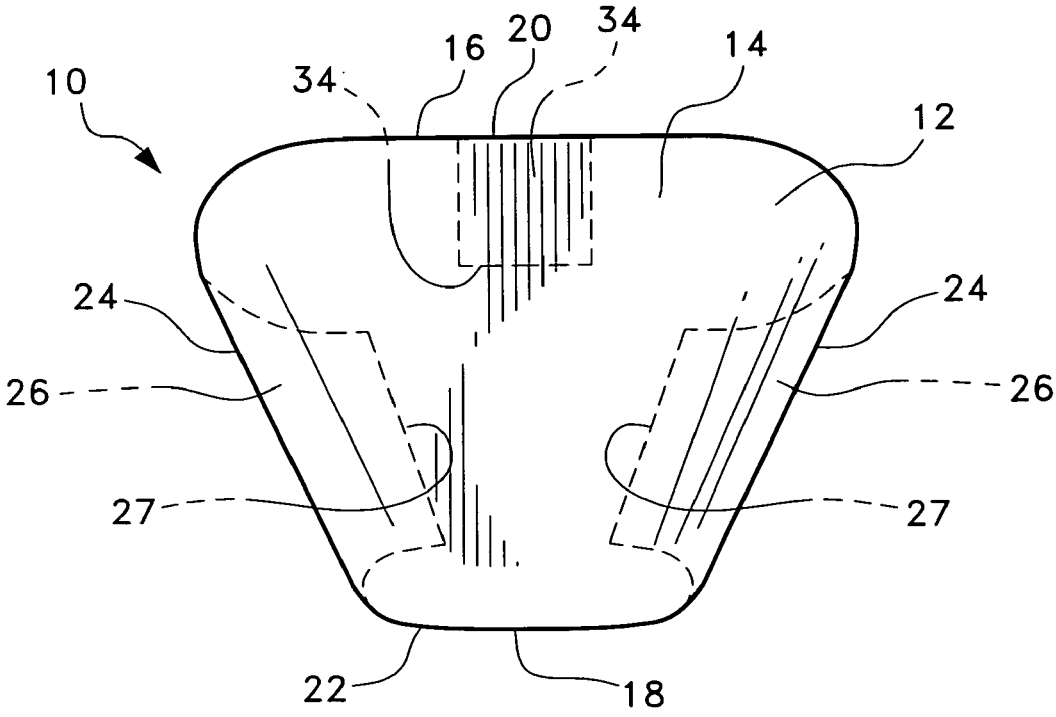
FIG. 2 is a front elevation view of the necktie knot cover of FIG. 1.
Figure 3:
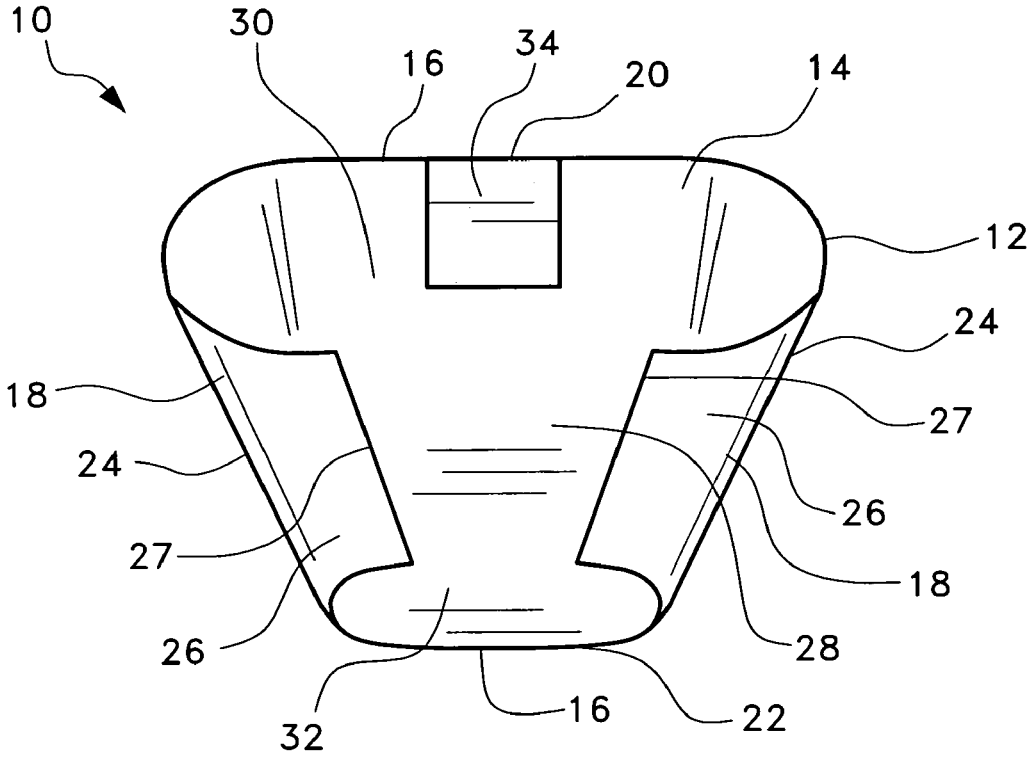
FIG. 3 is a rear elevation view of the knot cover of FIG. 1.
Figure 4:
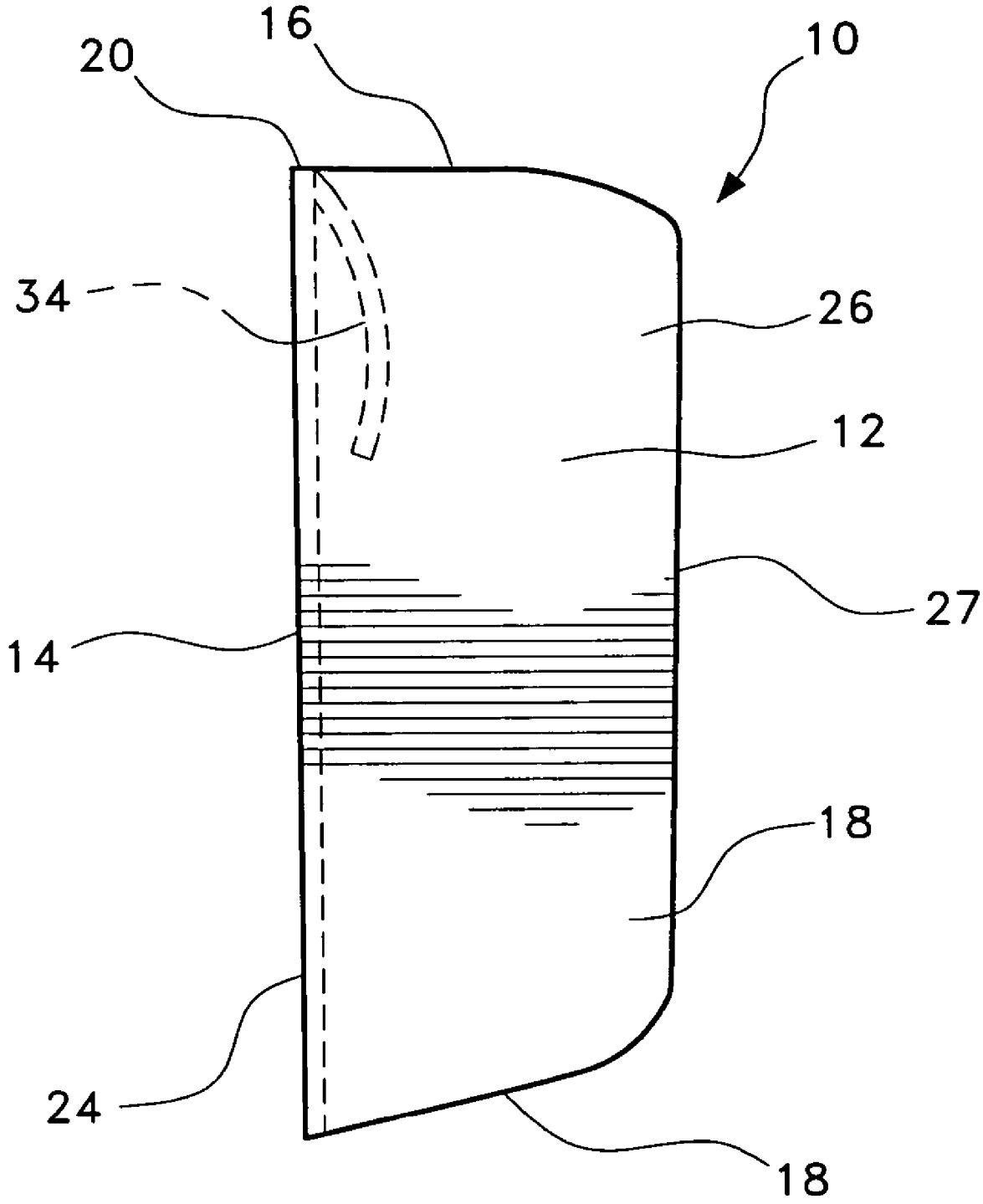
FIG. 4 is a side elevation view of the knot protector of FIG. 1.
Figure 5:
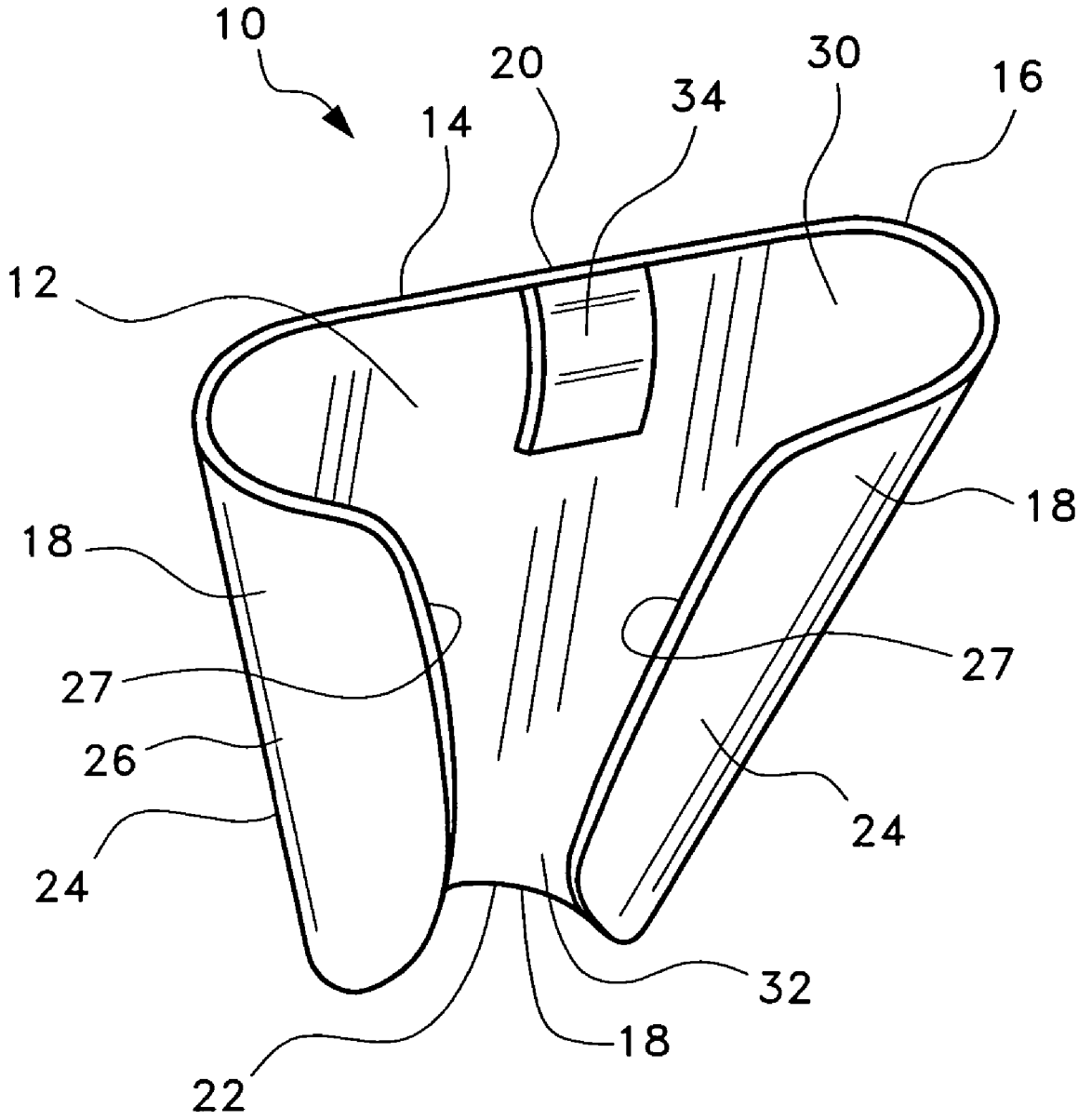
FIG. 5 is a perspective view of the knot protector of the present invention.

Referring to FIG. 1, there is shown an environmental, perspective view of the knot protector of the present invention generally referred to by the reference number 10. Necktie knot protector 10 is shown placed over a knot K of a necktie N and has a unitary shell 12 enclosing knot K. Unitary shell 12 has a generally triangular shell forward body 14 and opposed symmetrical wings 26 so shaped as to extend around the knot K. Unitary shell 12 has an inward and downward extending hook tab 34 engaging knot K to maintain the knot within unitary shell 12. The forward body 14 may have a decorative design 15 etched or otherwise fashioned thereon.

Referring to FIGS. 2–5, there is shown a front elevation view, a rear elevation view, a side elevation view and a perspective view, respectively, of the knot protector 10. Necktie knot protector 10 has a unitary, one-piece preformed shell 12 having a generally triangular forward body 14 having an upper rim 16, a lower rim 18 and opposing sides 24. Unitary shell 12 is generally symmetrical relative to a vertical central axis and shell body upper rim 16 has a central portion 20 along the central axis. Shell forward body lower rim 18 has lower rim central portion 22.

Opposed, symmetrical wings 26 extend back and inward from shell forward body opposing sides 24, ending in wing ends 27 forming a wing gap 28 therebetween. Shell forward body 14 and wings 26 form said unitary shell 12, defining a knot receiving space 30 having a bottom mouth 32. The central portion 20 of forward body upper rim 16 has an inward and downward extending hook tab 34 for engaging the upper portion of knot K of necktie N (see FIG. 1), thereby maintaining knot K within the knot receiving space 30 of unitary shell 12.

The unitary shell and hook tab may be fashioned from metal or molded or shaped from plastic as desired. Examples include plated or solid gold, silver, copper, nickel, stainless steel, and the like.

It is to be understood that the present invention is not limited to the embodiment described above, but encompasses any and all embodiments within the scope of the following claims.

I claim:

1. A necktie knot protector, comprising:

a unitary, one-piece preformed shell and hook tab, said shell having a generally flat forward body having a straight upper rim having a central portion, a lower rim having a central portion, and opposing sides;

said forward body having two opposed symmetrical wings extending from said opposing sides mutually turned back and inward from said opposing sides of said body, each of said wings terminating in a straight edge;

said wings being mutually spaced by a gap between said straight edges and defining with said body a receiving space having a narrow bottom mouth for receiving the knot of the necktie;

said shell having a having a horizontal width gradually reduced from said upper rim to said bottom mouth;

said hook tab is inwardly curved with respect to an inner surface of said shell and solely extending downward from the central portion of said upper rim;

whereby said protective shell is placed over the knot of a necktie by inserting said necktie below said knot through said gap and said protective shell is slid upward over the knot, said inward curved hook tab hook over the upper front portion of the knot to maintain the protective shell in a fixed position.

2. The necktie knot protector of claim 1, wherein said knot protector is made of metal.

3. The necktie knot protector of claim 1, wherein said knot protector is made of plastic.

4. The necktie knot protector of claim 1, wherein said knot protector is decorative.

* * * * *